US006078298A

United States Patent [19]

Planning et al.

[11] Patent Number: 6,078,298

[45] Date of Patent: Jun. 20, 2000

[54] DI-POLE WIDE BANDWIDTH ANTENNA

[75] Inventors: Matthew F. Planning, Milwaukee; Brian E. Petted, West Bend, both of Wis.

[73] Assignee: Terk Technologies Corporation, Commack, N.Y.

[21] Appl. No.: 09/178,904

[22] Filed: Oct. 26, 1998

[51] Int. Cl.[7] ..... H01Q 19/12

[52] U.S. Cl. ..... 343/840; 343/895

[58] Field of Search ..... 343/840, 895, 343/753; H01Q 19/12

[56] References Cited

U.S. PATENT DOCUMENTS

| | | | |
|---|---|---|---|
| D. 153,825 | 5/1949 | Riderman . | |
| D. 167,457 | 8/1952 | Gordon . | |
| D. 253,053 | 10/1979 | Wilson . | |
| D. 341,362 | 11/1993 | Taguchi . | |
| 647,996 | 4/1900 | Smith . | |
| 741,622 | 10/1903 | Brown . | |
| 1,020,032 | 3/1912 | Fessenden . | |
| 1,495,537 | 5/1924 | Stafford . | |
| 1,673,458 | 6/1928 | Jones . | |
| 1,990,649 | 2/1935 | Ilberg . | |
| 2,118,419 | 5/1938 | Scharlau . | |
| 2,153,589 | 4/1939 | Peterson . | |
| 2,259,318 | 10/1941 | Mouromtseff . | |
| 2,480,143 | 8/1949 | Lanxner . | |
| 2,482,767 | 9/1949 | Hansen . | |
| 2,495,579 | 1/1950 | Ferris et al. . | |
| 2,503,010 | 4/1950 | Tiley . | |
| 2,556,087 | 6/1951 | Iams . | |
| 2,583,745 | 1/1952 | Miller . | |
| 2,603,749 | 7/1952 | Kock . | |
| 2,608,658 | 8/1952 | Richards . | |
| 2,613,319 | 10/1952 | Lisbin et al. . | |
| 2,636,986 | 4/1953 | Riderman . | |
| 2,658,143 | 11/1953 | Fiet et al. . | |
| 2,671,853 | 3/1954 | Lindahl . | |
| 2,682,608 | 6/1954 | Johnson . | |
| 2,712,604 | 7/1955 | Thomas, Jr. et al. . | |
| 2,759,182 | 8/1956 | Chaffee . | |
| 2,760,191 | 8/1956 | Blackmer et al. . | |
| 2,763,003 | 9/1956 | Harris . | |
| 2,769,148 | 10/1956 | Clogston . | |
| 2,771,605 | 11/1956 | Kirkman . | |
| 2,831,187 | 4/1958 | Harris et al. . | |
| 2,895,129 | 7/1959 | Kamen et al. . | |
| 2,943,326 | 6/1960 | Thayer . | |
| 3,052,883 | 9/1962 | Rogers . | |
| 3,083,364 | 3/1963 | Scheldorf . | |
| 3,102,268 | 8/1963 | Foley . | |
| 3,197,778 | 7/1965 | Sajulan . | |
| 3,417,403 | 12/1968 | Fenwick . | |
| 3,521,289 | 7/1970 | Mayes et al. . | |
| 3,568,205 | 3/1971 | Buxton et al. . | |
| 3,573,840 | 4/1971 | Gouilou et al. . | |
| 3,623,114 | 11/1971 | Paine et al. . | |
| 3,680,147 | 7/1972 | Redlich . | |
| 3,683,393 | 8/1972 | Self . | |
| 3,713,166 | 1/1973 | Munson et al. . | |
| 3,733,609 | 5/1973 | Bartlett . | |
| 3,742,513 | 6/1973 | Ehrenspeck . | |
| 3,774,221 | 11/1973 | Francis . | |
| 3,778,717 | 12/1973 | Okoshi et al. . | |
| 3,902,178 | 8/1975 | Majkrzak . | |
| 4,031,537 | 6/1977 | Alford . | |
| 4,032,921 | 6/1977 | Sikina, Jr. et al. . | |
| 4,083,046 | 4/1978 | Kaloi . | |
| 4,126,864 | 11/1978 | Hopkins . | |
| 4,161,737 | 7/1979 | Albright . | |
| 4,204,212 | 5/1980 | Sindoris et al. . | |
| 4,205,318 | 5/1980 | Pisano . | |
| 4,323,900 | 4/1982 | Krall et al. . | |
| 4,712,112 | 12/1987 | Carr . | |
| 4,772,895 | 9/1988 | Garay et al. . | |
| 4,862,185 | 8/1989 | Andrews et al. | 343/761 |
| 5,010,350 | 4/1991 | Lipkin et al. . | |
| 5,081,469 | 1/1992 | Bones . | |
| 5,357,260 | 10/1994 | Roederer et al. | 343/754 |
| 5,528,249 | 6/1996 | Gafford et al. . | |
| 5,587,719 | 12/1996 | Steffy . | |
| 5,625,368 | 4/1997 | Howson et al. | 343/753 |
| 5,668,565 | 9/1997 | Robinson . | |
| 5,684,494 | 11/1997 | Nathrath et al. . | |
| 5,686,930 | 11/1997 | Brydon . | |
| 5,708,448 | 1/1998 | Wallace . | |
| 5,828,348 | 10/1998 | Tassoudji et al. | 343/895 |

*Primary Examiner*—Don Wong
*Assistant Examiner*—Shih-Chao Chen
*Attorney, Agent, or Firm*—Hoffmann & Baron, LLP

[57] ABSTRACT

A wideband receiver antenna that utilizes a right-circular cylinder-based reflector which is positioned one arc segment away from a di-pole receiving element for use with high definition television signal reception as well as FM receiver reception.

30 Claims, 11 Drawing Sheets

FIG - 11 PRIOR ART
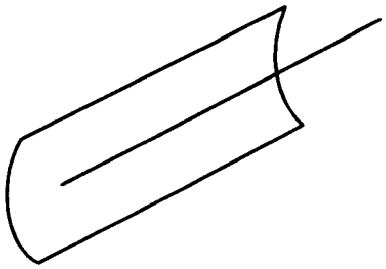
FIG - 12 PRIOR ART
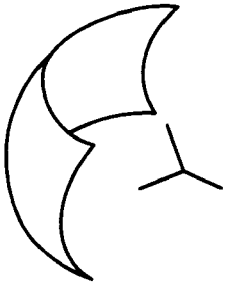
FIG - 13 PRIOR ART

DI-POLE WIDE BANDWIDTH ANTENNA

SPECIFICATION

1. Field of the Invention

The invention pertains to reflector antennas, and more particularly, to wide bandwidth antennas that use "sheet"-type reflectors for use with television and FM receivers.

2. Background of Invention

With the introduction of high definition television (HDTV), there is a need to provide wide bandwidth antennas that increase signal directivity (the ability to capture signals sent from a particular direction) while rejecting reflections of that signal that bounce off of surrounding structures which cause "ghosting" due to phase delays. In addition, there is a need for such wide bandwidth antennas for use with UHF reception as well as FM receivers.

Conventional "sheet"-type reflectors are categorized as parabolic-based, spherical-based, or corner-based reflective elements; FIGS. 10–15 of the present application depict these general categories of "sheet"-type reflectors and are taken from "Antenna Theory and Design", by Warren L. Stutzman and Gary A. Thiele, 1981, p. 483, and which is incorporated by reference herein. Thus, traditional categories of "sheet"-type reflectors do not teach nor suggest the use of right-circular cylinder based reflector sheets.

The following U.S. patents disclose various implementations of these "sheet"-type reflectors:

U.S. Pat. No. 2,943,326 (Thayer) discloses television antennas that utilize two conductive, semi-circular strips 1–4 that adhere to the outside surface of non-conductive antenna elements (see FIGS. 8–9 of the present application). However, in FIG. 8 neither strip 1 nor strip 2 have a concave side that is being used as a signal directing means; in fact, the concave sides of these strips 1 and 2 are electrically inoperative since they adhere to a non-conductor element 5. Similarly, in FIG. 9, the concave side of strip 3 is also electrically inoperative in that it adheres to a non-conductor element 7; and although the concave side 6 of the strip 4 is exposed to free space, it cannot act to direct an incoming signal onto the other conductive strip 3.

U.S. Pat. No. 2,603,749 (Kock) discloses a lens antenna for a circularwaveguide.

U.S. Pat. No. 1,020,032 (Fessenden) discloses an antenna that includes a horizontal reflector 27.

U.S. Pat. No. 2,118,419 (Scharlau) discloses a paraboloid reflector.

U.S. Pat. No. 2,153,589 (Peterson) discloses a transmitting antenna that utilizes a full cylindrical reflector.

U.S. Pat. No. 2,608,658 (Richards) discloses a television receiving antenna that utilizes two pieces of conductive material having a parabolic surface.

U.S. Pat. No. 2,831,187 (Harris) discloses a radio direction finding system that utilizes a hyperbolic reflector that is generally described as a "convex reflector".

Since it is ideal to position such antennas outside for best reception, de-icing and anti-icing mechanisms for these antennas are provided with these antennas, such as those disclosed in the following U.S. patents:

U.S. Pat. No. 2,712,604 (Thomas, Jr. et al.) discloses an antenna assembly with a de-icing means that basically comprises a plurality of circumferentially-spaced, vertically-extending heating elements consisting of high resistance wire positioned between laminations of a radome surface surrounding the radiating element. U.S. Pat. No. 2,760,191 (Blackmer et al.) also discloses a de-icing means for a cylindrical antenna. U.S. Pat. No. 4,126,864 (Hopkins) discloses an ice shield for a microwave antenna. U.S. Pat. No. 5,010,350 (Lipkin et al.) discloses an anti-icing and de-icing system for a reflector-type microwave antenna. U.S. Pat. No. 5,528,249 (Gafford et al.) discloses an anti-ice radome that uses slotted elements.

The following U.S. patents disclose the use of helical-wound receiving elements: U.S. Pat. No. 1,495,537 (Stafford); U.S. Pat. No. 2,583,745 (Miller); U.S. Pat. No. 2,613,319 (Lisbin); U.S. Pat. No. 2,636,986 (Riderman); U.S. Pat. No. 2,682,608 (Johnson); U.S. Pat. No. 3,052,883 (Rogers); U.S. Pat. No. 3,417,403 (Fenwick); U.S. Pat. No. 3,521,289; U.S. Pat. No. 3,683,393 (Self); U.S. Pat. No. 3,774,221(Francis, deceased); U.S. Pat. No. 3,902,178 (Majkrzak); U.S. Pat. No. 4,161,737 (Albright); U.S. Pat. No. 4,204,212 (Sindoris et al.); U.S. Pat. No. 4,323,900 (Krall et al.); U.S. Pat. No. 4,205,318 (Pisano); U.S. Pat. No. 5,587,719 (Steffy) and U.S. Des. 153,825 (Riderman).

However, none of these references appear to teach or suggest increasing the directivity of signal reception while minimizing the number of delayed replicas of the transmitted primary signal (i.e., ghosting), such as is required for high definition television (HDTV) reception, by utilizing at least one arc segment of a hollow right-circular-cylinder reflector in combination with a di-pole receiving element.

OBJECTS OF THE INVENTION

Accordingly, it is the general object of this invention to overcome the disadvantages of the prior art.

It is an object of the present invention to provide a television and/or FM receiver antenna that creates a finite range of reception from a given direction.

It is still yet another object of the present invention to provide an antenna that increases the directivity of signal reception.

It is still yet another object of the present invention to provide an antenna that minimizes the number of delayed replicas of the transmitted primary signal, i.e., ghosting.

It is still yet another object of the present invention to provide an antenna for reception of high definition television (HDTV) signals.

It is still even yet another object of the present invention to provide an antenna that reduces HDTV receiver locking occurrences due to ghosting.

It is even yet another object of the present invention to provide an improved very high frequency (VHF) receiving antenna.

It is still yet even a further object of the present invention to provide an improved ultra high frequency (UHF) receiving antenna.

It is still yet even a further object of the present invention to provide a substitute for Yagi-Uda antennas.

It is still even another object of the present invention to provide a substitute for conventional "rabbit ear" antennas.

It is still yet another object of the present invention to provide a substitute for conventional UHF loop antennas.

It is even yet another object of the present invention to provide a substitute for conventional FM receiver antennas.

It is even yet another object of the present invention to enhance a receiver's frontto-back ratio.

SUMMARY OF THE INVENTION

These and other objects of the instant invention are achieved by providing a wideband receiver antenna adapted to be coupled to a receiver for receiving wirelessly transmitted signals (e.g., high definition television (HDTV) signals, ultra-high frequency (UHF) signals, frequency modulated (FM) radio signals, etc.). The antenna comprises: (a) a receiving element; and (b) a right-circular cylinder (RCC)-based reflector. The RCC-based reflector forms at least one arc segment of a hollow RCC having a predetermined radius. The RCC-based reflector comprises a convex side and a concave side wherein the concave side forms signal directing means and the convex side forms signal reflecting means.

These and other objects of the instant invention are also achieved by providing a method for receiving wide bandwidth signals (e.g., high definition television (HDTV) signals, ultra-high frequency (UHF) signals, frequency modulated (FM) radio signals, etc.) transmitted wirelessly for use by a receiver. The method comprises the steps of: (a) providing a receiving element; (b) positioning a reflector that comprises at least one arc segment of a right-circular-cylinder (RCC) at a distance away from the receiving element that is given by the radius of the RCC, with a concave side formed by the reflector facing the receiving element; and (c) electrically coupling the receiving element to the receiver.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 11 is a prior art parabolic cylinder reflector antenna;

FIG. 12 is a prior art parabolic torus reflector antenna;

FIG. 13 is a prior art spherical reflector antenna;

DETAILED DESCRIPTION OF THE PREFERRED EMBODIMENT

Figure 1:
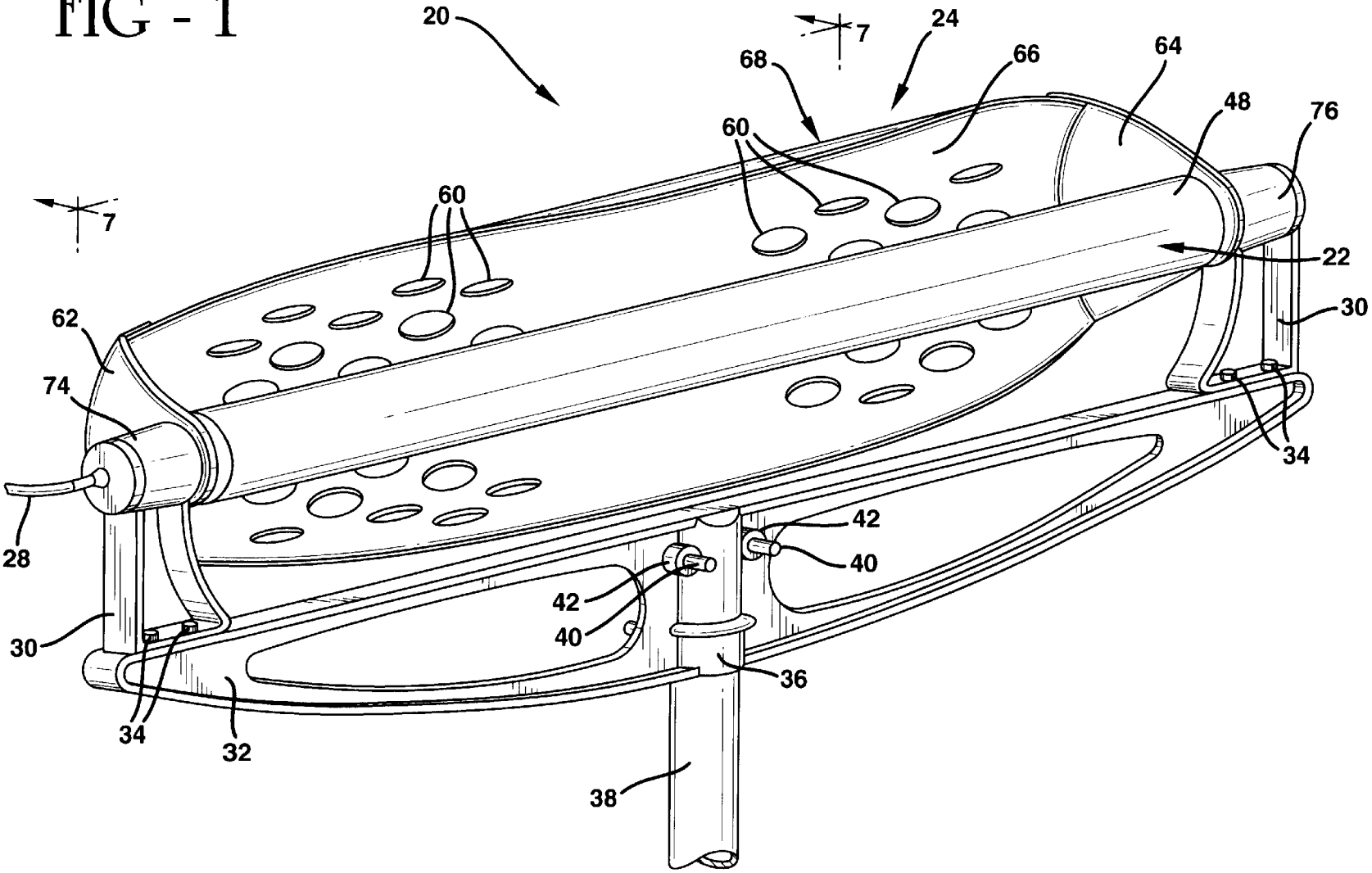
FIG. 1 is an isometric view of the present invention.

Referring now in detail to the various figures of the drawing wherein like reference characters refer to like parts, there is shown at 20 a di-pole wide bandwidth antenna (hereinafter "DWBA") which is designed for, and capable of, effectively receiving frequencies between 50 MHz and 850 MHz. This frequency range corresponds to signals which fall within the Very High Frequency (VHF) and Ultra High Frequency (UHF) bands. In terms of channels, this covers broadcast TV channels 2–69 and broadcast FM radio band.

Figures 6, 6A:
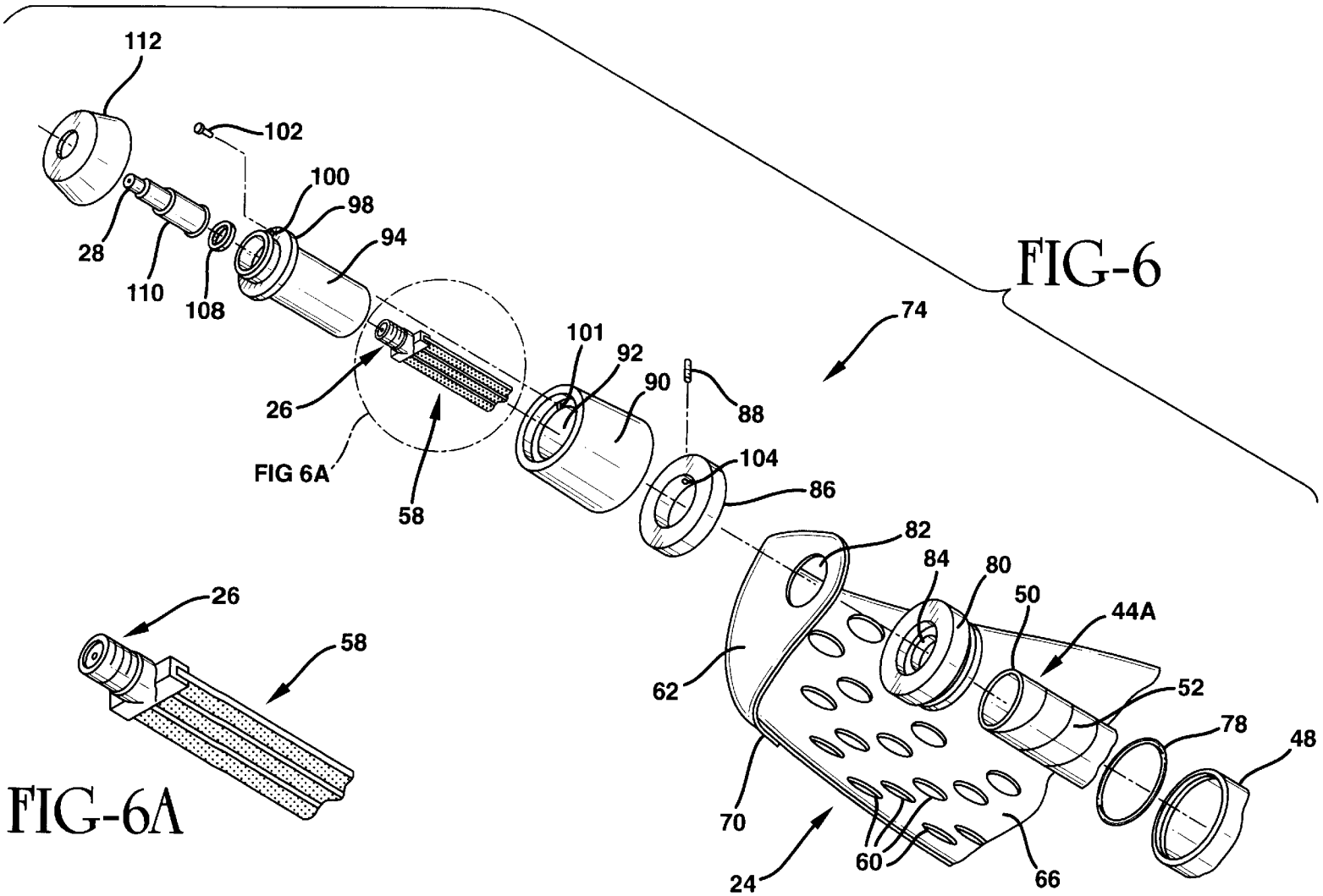
FIG. 6 is an exploded partial isometric view of the reflector mounting assembly and connector of the present invention.
FIG. 6A is an enlarged view of a printed wire board that forms the electrical connection between the circuit board and the connector.

In particular, the DWBA 20 comprises a receiving element 22 and a reflector 24. The receiving element 22 also comprises an antenna connector 26 (FIGS. 6 and 6A) and electrical cable 28 (e.g., coax cable) that couples to the television (or FM receiver) connector (not shown) to bring the received signal to the television set (or FM receiver, neither of which are shown). For ideal reception, the DWBA 20 is mounted outside of the home, building, etc. To support the DWBA 20 outside, mounting brackets 30 are secured to respective ends of the receiving element 22. These brackets 30 are then releasably coupled to a mast 32 via securing means (e.g., bolts 34/nuts, etc.). The mast 32 has a central coupling member 36 that receives a mast pole 38 and is the mast 32 is then releasably secured to the pole 38 via securing means (e.g., bolts 40/nuts 42). The mast pole 38 can be attached to a chimney, roof or any other outside structure (none of which is shown).

Figure 2:
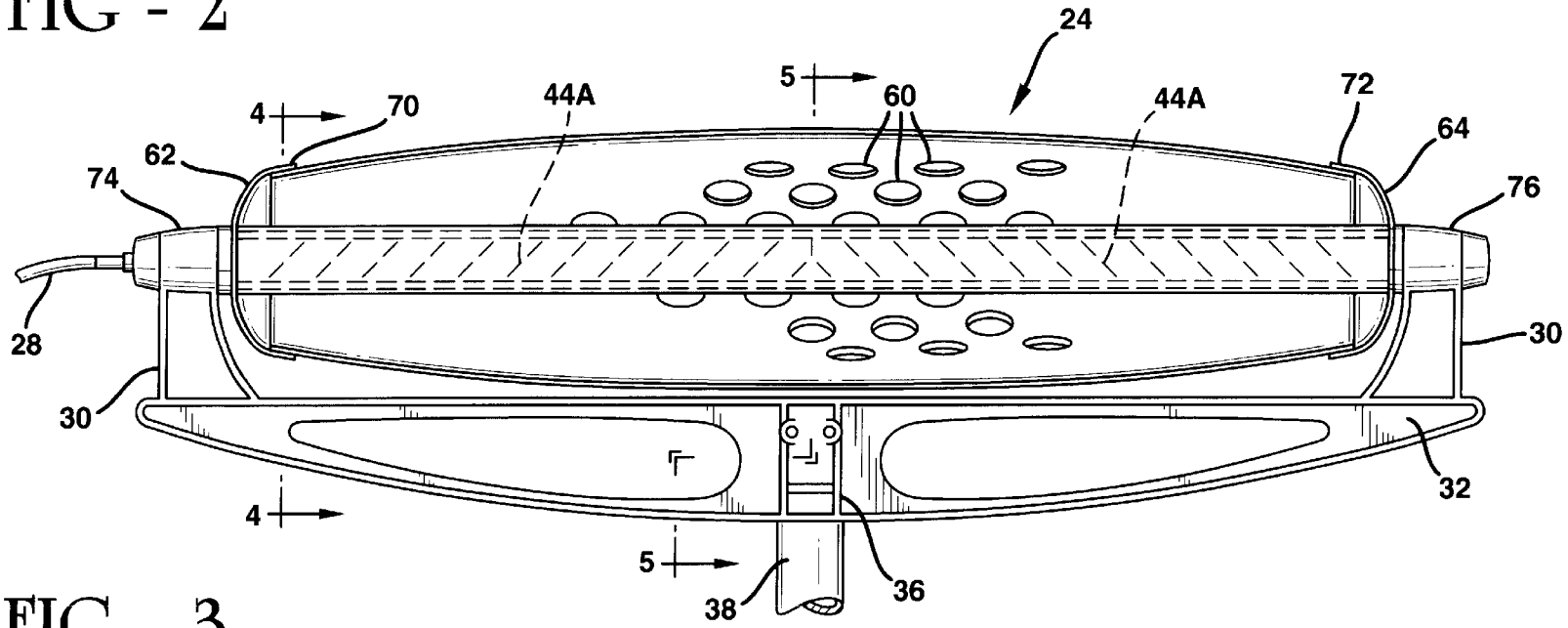
FIG. 2 is a front view of the present invention.

The receiving element 22 of the DWBA 20 comprises a di-pole configuration, i.e., two opposing elements 44A and 44B (FIG. 2) that are electrically connected to the input points of a circuit board 46, all of which are contained inside a cover 48 (e.g., an ultraviolet (UV) stable polymer or plastic, or other similar environmental barrier to protect the receiving element 22). In particular, the receiving element 22 comprises a single, hollow, non-conductive support 50 (FIG. 7, e.g., PVC tubing), with the circuit board 46 positioned inside the support 50. The inside diameter 54 (FIG. 7) of the support 50 is approximately 1.0". Each di-pole element 44A/44B is formed by a metallic foil strip 52 (e.g., 1.0" wide and 0.001" thick, adhesive Cu foil tape manufactured by 3M®) that is spirally wound around the support 50. In addition, the metallic foil strip of di-pole element 44A is wound in opposite sense to the metallic foil strip of di-pole element 44B; i.e., one di-pole element is a right-hand helix and the other di-pole element is a left-hand helix.

The spacing between turns of the helices is constant (e.g., 0.03", constant pitch) and is held to a minimum without making contact with one another. The uncoiled length of each helix is approximately 5.7 feet. Although wrapping the metallic foil strip 52 around the support 50 is one method of creating the helices, an alternative method uses an electroplating process for creating the helices by embedding metallic particles on the support.

Figure 7:
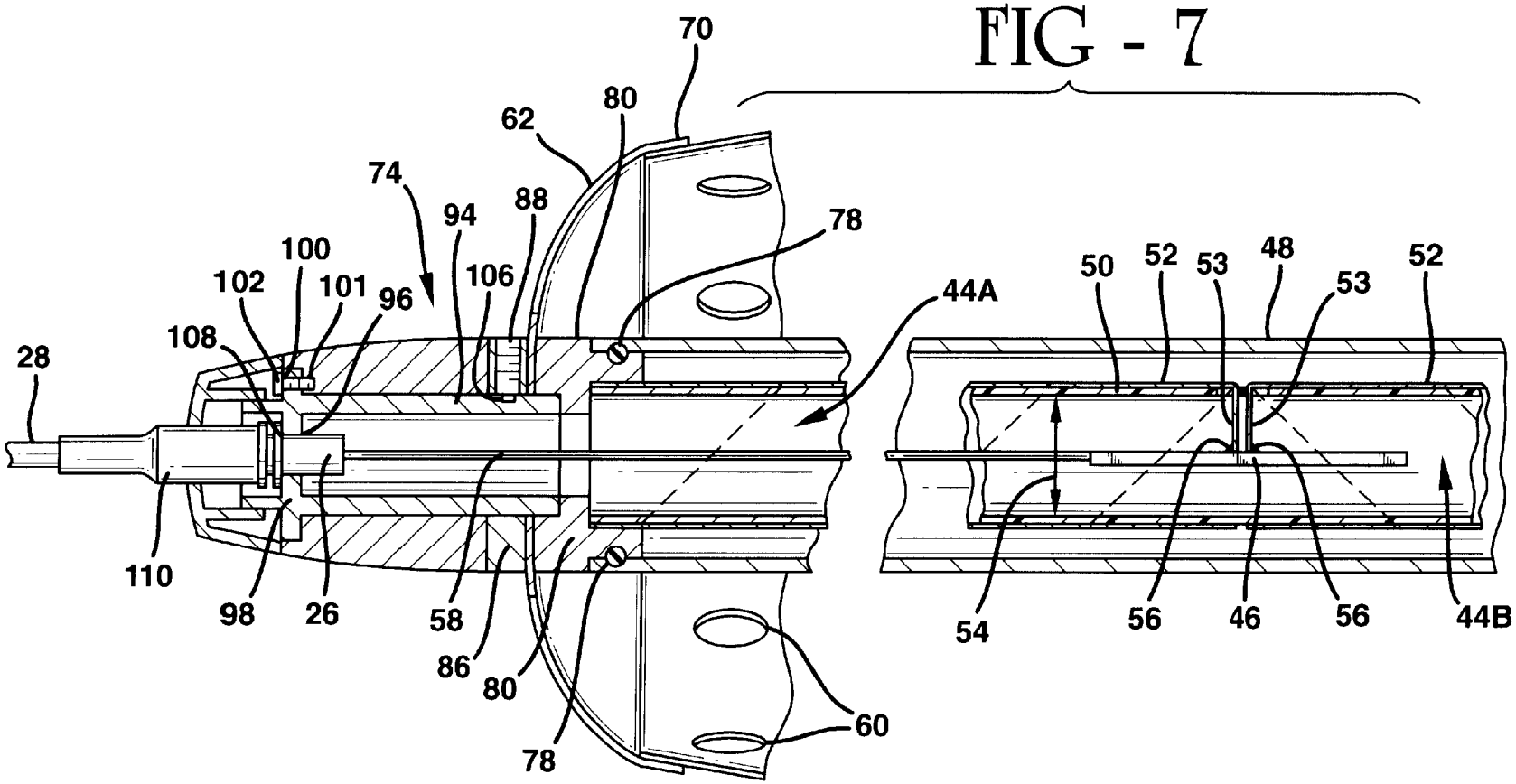
FIG. 7 is a partial cross-sectional view of the present invention.
Figure 8:
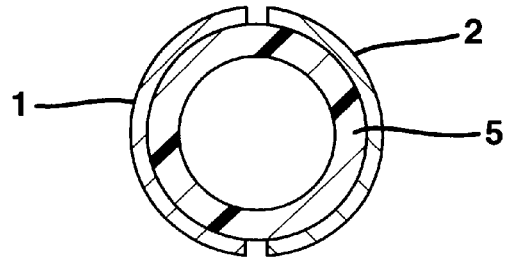
FIG - 8 PRIOR ART
FIG. 8 is a prior art cross-sectional view of a reflector applied to a di-pole element.
Figure 9:
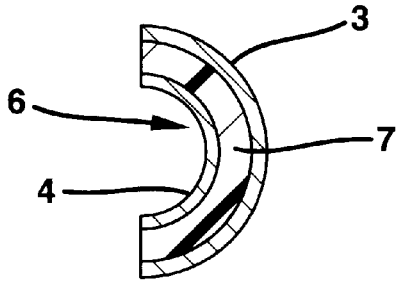
FIG - 9 PRIOR ART
FIG. 9 is another prior art cross-sectional side view of a reflector applied to a di-pole element.
Figure 10:
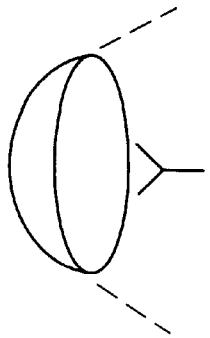
FIG - 10 PRIOR ART
FIG. 10 is a prior art paraboloid reflector antenna.
Figure 14:
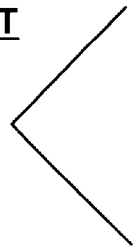
FIG - 14 PRIOR ART
FIG. 14 is a prior art corner reflector antenna.
Figure 15:
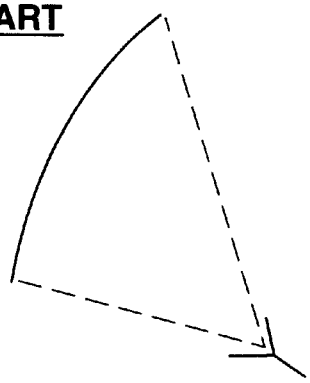
FIG - 15 PRIOR ART
FIG. 15 is a prior art offset front-fed reflector antenna.

The end 53 of the metallic foil strip 52 for each di-pole element 44A/44B is electrically connected (e.g., soldered 56) to respective inputs of the circuit board 46, as shown most clearly in FIG. 7. Although not shown, the circuit board 46 may contain an amplifier, or balun, etc., for amplifying or otherwise properly conditioning the received signal; each end 53 of each metallic foil strip 52 is electrically coupled to a respective input of the amplifier, balun or other electrical signal-conditioning device on the circuit board 46. The output of the circuit board 46 is then fed through a conductor means 58 (e.g., a printed wire board (PWB), or a coax cable, etc.) to the antenna connector 26.

Figure 4:
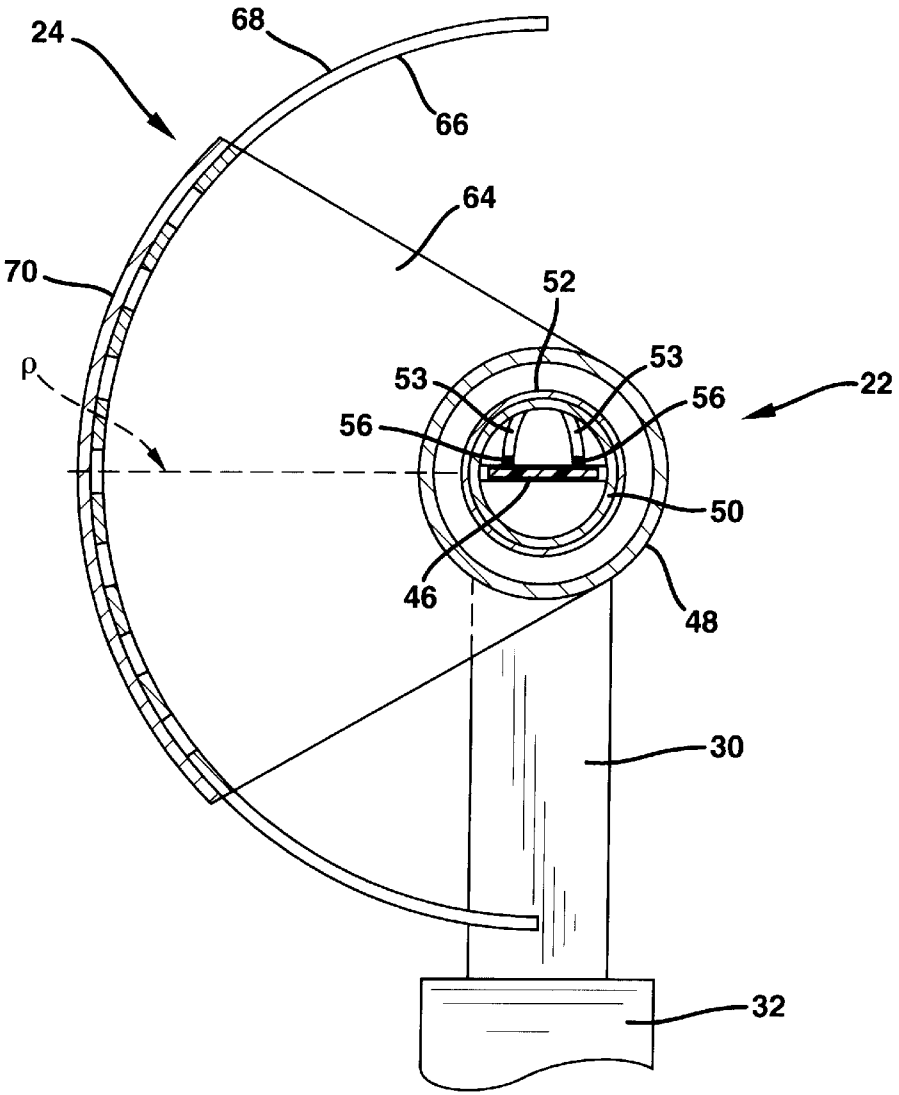
FIG. 4 is a cross-sectional view taken along line 4—4 of FIG. 2.
Figure 5:
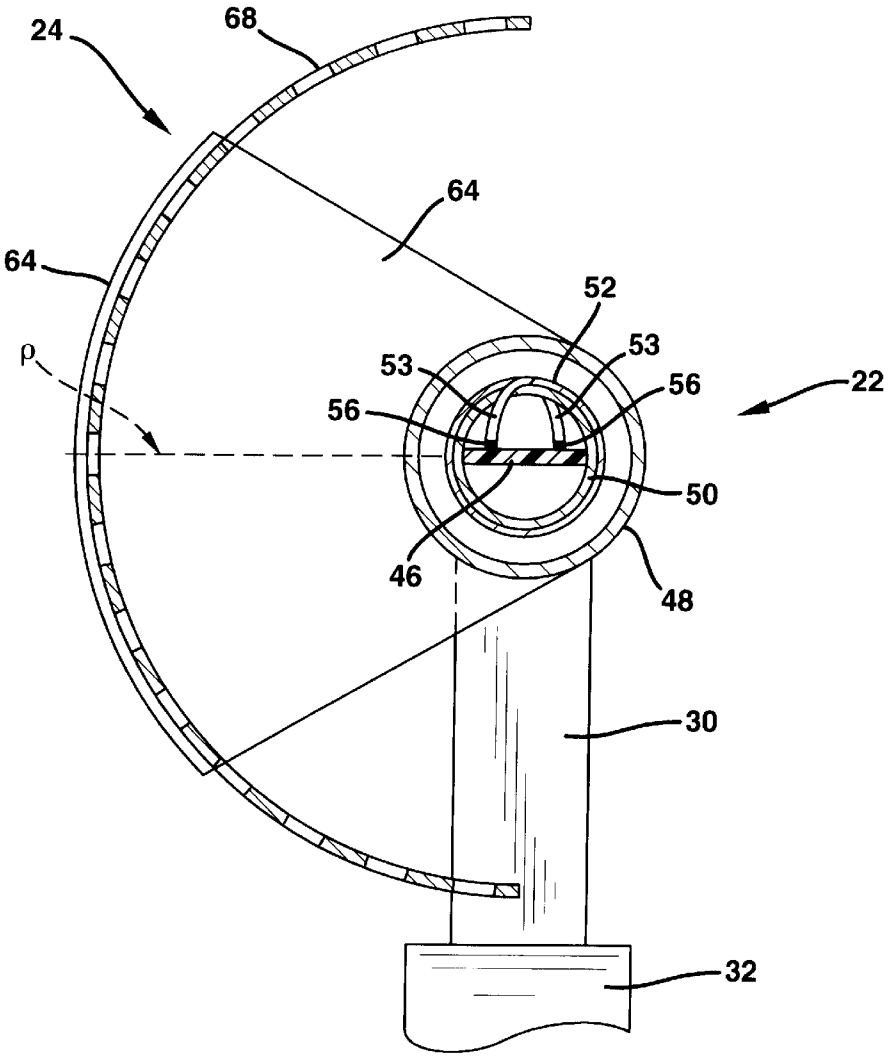
FIG. 5 is a cross-sectional view taken along line 5—5 of FIG. 2.

The reflector 24 comprises a totally unique design in that it is comprises arc segments of a right-circular cylinder, as will be discussed in detail later. Suffice it to say that the receiving element 22 is positioned a distance of ρ (FIGS. 4–5) away from the reflector 24, where ρ is the radius of the right-circular cylinder.

Since one of the leading environmental effects on the reflector 24 includes wind loading, the reflector 24 comprises a plurality of oval perforations 60 that permit the wind to pass through the reflector 24. The size of the perforations is given by the following standard: the maximum dimension of the perforation (i.e., diameter if it is a circle, major axis if it is an oval) is no longer than 1/100 of the wavelength of the highest frequency received.

Figure 3:
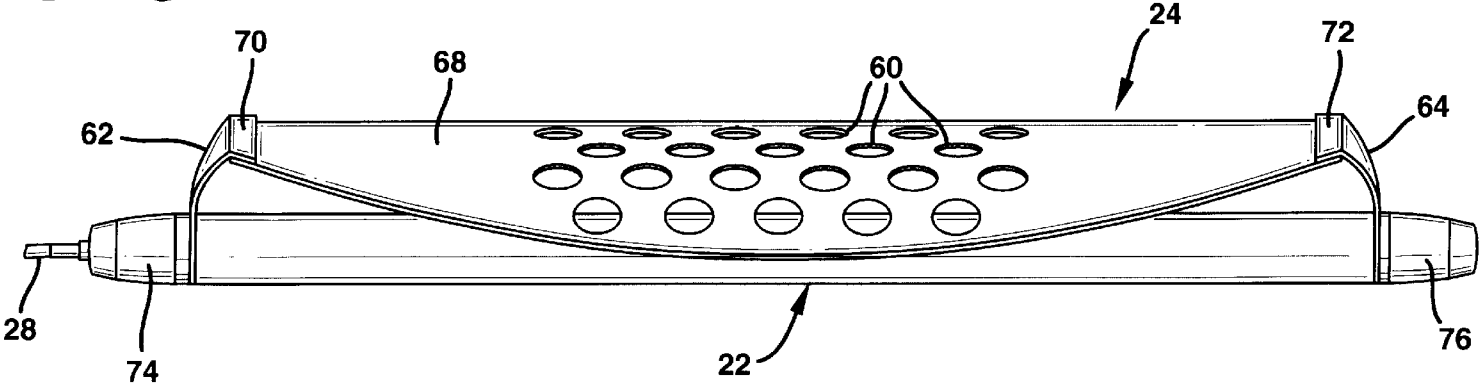
FIG. 3 is a top view of the present invention.

The reflector 24 is coupled to the receiving element 22 via end couplings 62 and 64. These couplings 62 and 64 are designed to separate the concave side 66 of the reflector 24 from the center of the receiving element 22 by the distance p, discussed previously. To minimize any interference with the reflector 24 operation, these end couplings 62 and 64 comprise a non-conductive material (e.g., ABS plastic). To maximize the exposure of the concave side 66 of the reflector 24 opposite the receiving element 22, the end couplings 62/64 are coupled (e.g., glued, fastened, etc.) to the convex side 68 via respective coupling surfaces 70 and 72 (most clearly shown in FIG. 3). It is also within the broadest scope of the present invention to include a reflector having end couplings that are unitized with the reflector 24 so that the end couplings form a smooth continuous surface with the reflector (i.e., the coupling surfaces 70/72 are integral with the reflector 24) while retaining their non-conductive composition.

Each end of the reflector 24 is mounted to the ends of the receiving element 22 via the end couplings 62/64 and respective mounting assemblies 74 and 76. The reflector mounting assembly 74 is depicted in an exploded condition in FIG. 6. In particular, the assembly 74 comprises one end of the cover 48. An O-ring 78 seats inside the end of the cover 48 and through which one end of the di-pole element 44A protrudes. A cover bracket 80 slips over the end of the di-pole element 44A and is threadedly engaged inside the cover 48. A hole 82 in the end coupling 62 is aligned with the opening 84 in the bracket 80. A locking ring 86 is aligned with the hole 82 and includes a locking screw 88, which will be discussed later. A cradle member 90 having an inner passage 92 is aligned with the opening in the ring 86. The conductor means 58 (e.g., a PWB shown in FIGS. 6 and 6A), which is electrically coupled to the electrical connector 26 (e.g., type-F, female connector), passes through all of the previously mentioned components to connect to the circuit board 46, as discussed earlier. A keyed shaft 94 receives and captures the electrical connector 26 via an internal aperture 96 (FIG. 7); the keyed shaft 94 fits into the cradle member 90. An annular ring 98 on the outside surface of the keyed shaft 94 includes a hole 100 through which an adjustment screw 102 passes for securing the keyed shaft 94 to another hole 101 in the cradle member 90. The locking screw 88 passes through an opening 104 in the locking ring 86 and engages an opening 106 in the outside surface of the keyed shaft 94. A seal 108 slips over the electrical connector 26 that protrudes from the keyed shaft 94. A plug 110, which is electrically coupled to the electrical cable 28, fits snugly over the end of the electrical connector 26 (and thereby establishes a proper electrical coupling) and protrudes through an end cap 112. The end cap 112 closes off the mounting assembly 74.

Suffice it to say that the reflector mounting assembly 76 is similar to the reflector mounting assembly 74 except that it does not comprise the electrical connector 26, connector means 58, keyed shaft 94 and plug 110, and, as such, will not be further discussed.

Figure 16:
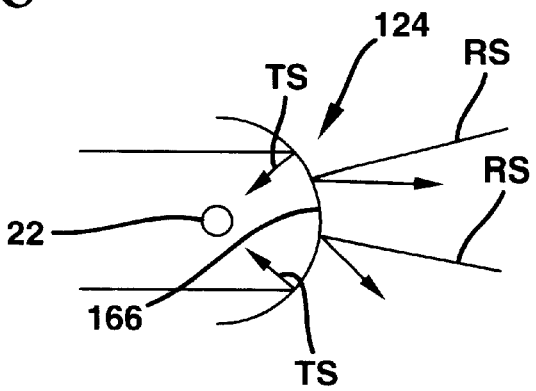
FIG. 16 is a depiction of the directed and reflected signals of the present invention.
Figure 18:
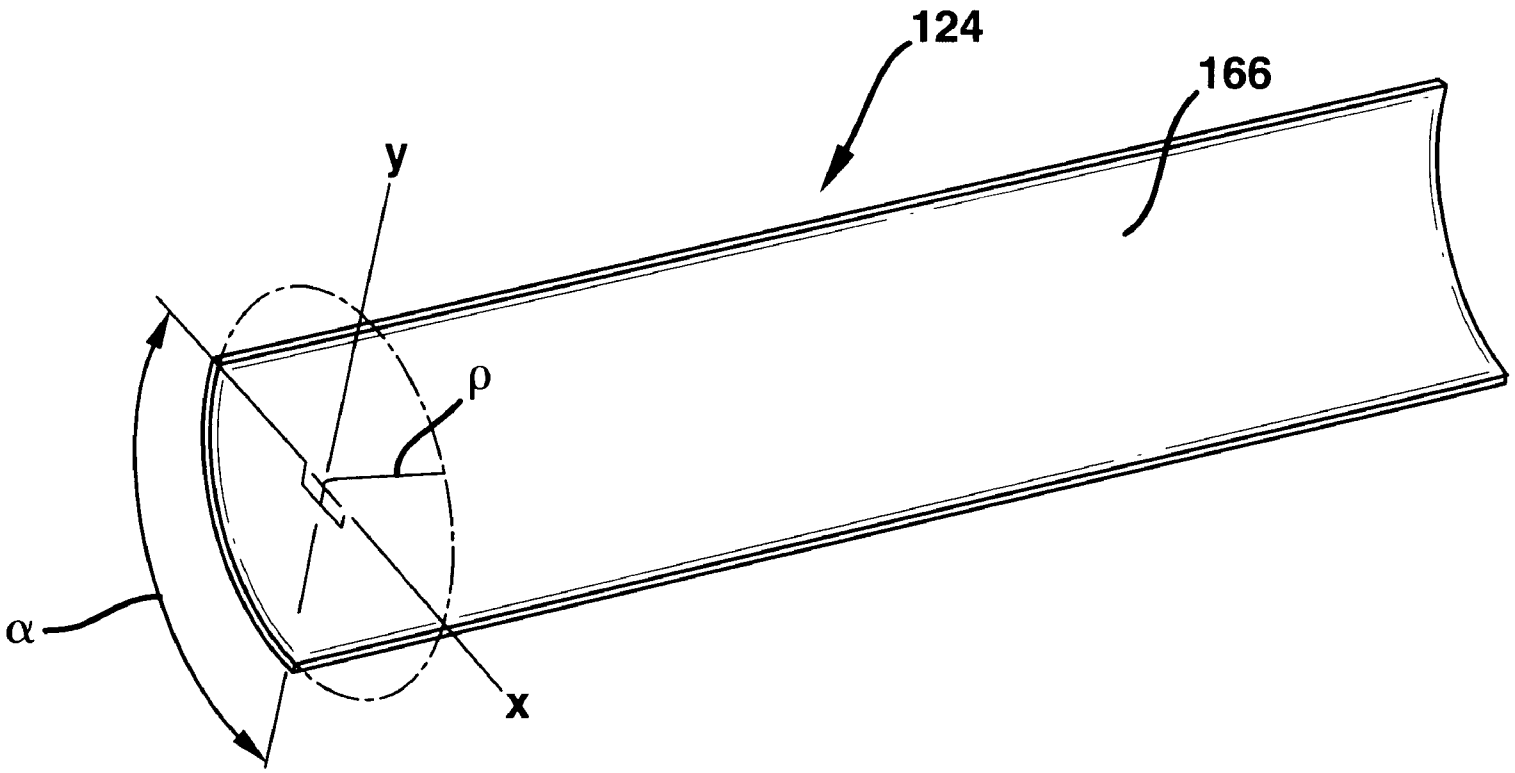
FIG. 18 is a depiction of a right-circular cylinder-based reflector having a single arc segment configuration.

As mentioned earlier, the reflector 24 is a totally unique design in that it comprises arc segments of a hollow right-circular cylinder (hereinafter "RCC"). This can be most clearly seen in FIG. 18, where this RCC-based reflector, hereinafter known as reflector 124, is a ¼ arc segment of a hollow RCC having a radius ρ and defined by the arc α (i.e., ¼ of a circle). The x-axis and y-axis shown in FIG. 18 are perpendicular with respect to each other. This RCC-based reflector 124 is then positioned a distance ρ (FIG. 5) from the receiving element 22; in particular, the concave side 166 is placed a distance ρ from the center of the receiving element 22. As shown in FIG. 16, the concave side 166 thus acts as signal directing means, directing the signals (TS) emitted from a remote transmitter (not shown) in the desired frequency range onto the receiving element 22, while the convex side 168 acts as signal reflecting means, reflecting away (from the receiving element 22) those signals (RS) in the desired frequency range that have been reflected off of surrounding structures, vehicles, etc., that would normally cause ghosting. Thus, this RCC-based reflector 124 is novel and unobvious in light of the prior art which heretofore comprises parabolic-based, spherical-based, or corner-based reflective elements (FIGS. 10–15, discussed previously). This RCC-based reflector 124 establishes a finite range of reception from a given direction, increases the directivity of signal reception, and minimizes the number of delayed replicas of the transmitted primary signal, i.e., ghosting. In addition to its use in HDTV reception, another preferable use of the reflector 124 is for a UHF receiver.

Figure 17:
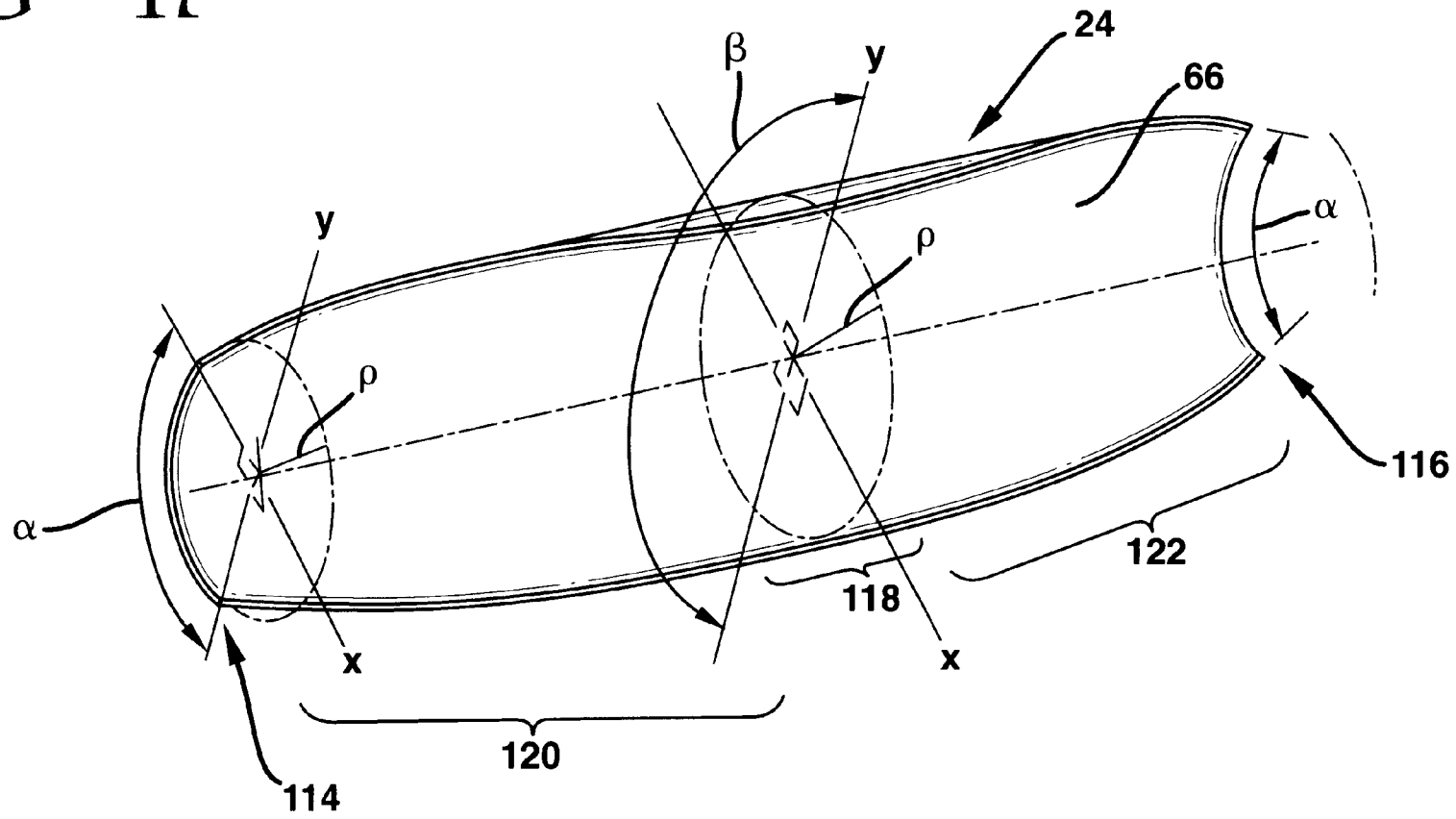
FIG. 17 is a depiction of a right-circular cylinder-based reflector having a composite arc segment configuration.

That being understood, the reflector 24 comprises a composite arc segment configuration, as most clearly shown in FIG. 17. In particular, the reflector 24 (depicted without the perforations 60 for clarity) comprises end portions 114 and 116 that are based on the arc a segment and which then taper, linearly, upward (thereby forming intermediate portions 120 and 122) as one moves toward the center 118 which is a ½ arc segment of a hollow RCC having a radius of ρ and defined by the arc β (i.e., ½ of a circle). Each x-axis and y-axis shown in FIG. 17 are perpendicular with respect to each other. As an example, if the length of the reflector 24 shown in FIG. 17 were approximately 36 inches (and the RCC being used has a ρ of 4 inches), the center portion 118 may have a length of 14 inches; thus the reflector 24 would have ends that comprise arc a segments (i.e., ¼ arc segments of a hollow RCC) that taper upward for approximately 11 inches in towards the center portion 118 until the arc β segment (i.e., ½ arc segment of a hollow RCC) is reached. This composite configuration of reflector 24 is preferably directed to HDTV operation based on the HDTV frequency allocation, namely the UHF band; the 180° portion (i.e., the center portion 118) may improve the directivity of the receiving element 22 in the desired frequency range.

It should be understood that the reflector 24 surface is a smooth continuous surface and that as the taper of the intermediate sections 120/122 increases from the ends 114/116 to the center portion 118, there is no corner or edge formed on the concave side 66 nor on the convex side 68.

Another leading environmental effect on the reflector 24 is icing. Although not shown, icing may be controlled in several ways, but a preferred method utilizes resistive heating, i.e., applying direct current (DC) to the reflector 24 and monitoring its temperature by switching the current on/off using an inexpensive, solid-state temperature sensor that is mounted on the reflector 24 itself. The DC may be tapped from the circuit board 46 (e.g., if an amplifier were used on the circuit board 46, the amplifier's power source could provide the DC).

It is within the broadest scope of this invention to include a solid non-conductive support (as opposed to a hollow support 50 discussed earlier), although it should be understood that both material composition and thickness contribute to deviations from the ideal (an air support) performance.

Without further elaboration, the foregoing will so fully illustrate our invention that others may, by applying current or future knowledge, readily adopt the same for use under various conditions of service.

We claim:

1. A wideband receiver antenna which can be coupled to a receiver for receiving wirelessly transmitted signals, said antenna comprising:

(a) a receiving element; and (b) a right-circular cylinder (RCC) reflector, said (RCC) reflector forming at least one arc segment of a hollow RCC having a predetermined radius, said (RCC) reflector comprising a convex side and a concave side, said concave side forming signal directing means and said convex side forming signal reflecting means.

2. The wideband receiving antenna of claim 1 wherein said concave side of said (RCC) reflector faces said receiving element and wherein said receiving element is positioned at a distance of said predetermined radius away from said concave side.

3. The wideband receiver antenna of claim 2 further comprising a pair of end couplings for securing said (RCC) reflector at said predetermined radius away from said receiving element, each of said end couplings comprising a non-conductive material.

4. The wideband receiver antenna of claim 3 wherein said convex side of said (RCC) reflector faces away from said receiving element and wherein each of said end couplings couples to said convex side.

5. The wideband receiver antenna of claim 2 wherein said (RCC) reflector comprises perforations therein to reduce wind loading.

6. The wideband receiver of claim 5 wherein said perforations are oval-shaped.

7. The wideband receiver antenna of claim 2 wherein said receiving element comprises:

(a) a non-conductive cylindrical support;

(b) a first conductive layer wound in a first helical direction around said non-conductive cylindrical support; and (c) a second conductive layer wound in a second helical direction around said non-conductive cylindrical support, said second helical direction being opposite to said first helical direction.

8. The wideband receiver antenna of claim 7 wherein said first and second conductive layers are electrically coupled to respective inputs of a circuit board internal to said non-conductive cylindrical support.

9. The wideband receiver antenna of claim 8 wherein said circuit board comprises an output and wherein said output is electrically coupled to an electrical connector, said electrical connector providing said output to a cable which can be coupled to the receiver.

10. The wideband receiver antenna of claim 9 wherein said output is electrically coupled to said electrical connector by a printed wire board.

11. The wideband receiver antenna of claim 7 wherein said first conductive layer and said second conductive layer comprise conductive tape.

12. The wideband receiver antenna of claim 11 wherein said conductive tape comprises copper tape.

13. The wideband receiver antenna of claim 7 wherein said first conductive layer comprises a first set of helical segments and said second conductive layer comprises a second set of helical segments and wherein said first set of helical segments do not contact each other and wherein said second set of helical segments do not contact each other.

14. The wideband receiver antenna of claim 7 wherein said non-conductive cylindrical support is hollow.

15. The wideband receiver antenna of claim 1 wherein said at least one arc segment of said hollow RCC is a ¼ arc segment of said hollow RCC.

16. The wideband receiver antenna of claim 1 wherein said at least one arc segment of said hollow RCC comprises:

(a) a ¼ arc segment of said hollow RCC that forms a first end of said reflector;

(b) a ½ arc segment of said hollow RCC that forms a center portion of said reflector;

(c) a ¼ arc segment of said hollow RCC that forms a second end of said reflector; and (d) said first end and said second end of said reflector being coupled to said center portion via respective intermediate portions that taper linearly from said ¼ arc segment of said hollow RCC to said ½ arc segment of said hollow RCC.

17. The wideband receiving antenna of claim 16 wherein said concave side of said (RCC) reflector faces said receiving element and wherein said receiving element is positioned at a distance of said predetermined radius away from said concave side.

18. The wideband receiver antenna of claim 17 further comprising a pair of end couplings for securing said (RCC) reflector at said predetermined radius away from said receiving element, each of said end couplings comprising a non-conductive material.

19. The wideband receiver antenna of claim 18 wherein said convex side of said (RCC) reflector faces away from said receiving element and wherein each of said end couplings couples to said convex side.

20. The wideband receiver antenna of claim 17 wherein said (RCC) reflector comprises perforations therein to reduce wind loading.

21. The wideband receiver of claim 20 wherein said perforations are oval-shaped.

22. The wideband receiver antenna of claim 17 wherein said receiving element comprises:

(a) a non-conductive cylindrical support;

(b) a first conductive layer wound in a first helical direction around said non-conductive cylindrical support; and (c) a second conductive layer wound in a second helical direction around said non-conductive cylindrical support, said second helical direction being opposite to said first helical direction.

23. The wideband receiver antenna of claim 22 wherein said first and second conductive layers are electrically coupled to respective inputs of a circuit board internal to said non-conductive cylindrical support.

24. The wideband receiver antenna of claim 23 wherein said circuit board comprises an output and wherein said output is electrically coupled to an electrical connector, said electrical connector providing said output to a cable which can be coupled to the receiver.

25. The wideband receiver antenna of claim 24 wherein said output is electrically coupled to said electrical connector by a printed wire board.

26. The wideband receiver antenna of claim 22 wherein said first conductive layer and said second conductive layer comprise conductive tape.

27. The wideband receiver antenna of claim 26 wherein said conductive tape comprises copper tape.

28. The wideband receiver antenna of claim 22 wherein said first conductive layer comprises a first set of helical segments and said second conductive layer comprises a second set of helical segments and wherein said first set of helical segments do not contact each other and wherein said second set of helical segments do not contact each other.

29. The wideband receiver antenna of claim 22 wherein said non-conductive cylindrical support is hollow.

30. A method for receiving wide bandwidth signals transmitted wirelessly for use by a receiver, said method comprising the steps of:

(a) providing a receiving element;

(b) positioning a reflector that comprises at least one arc segment of a right-circular-cylinder (RCC) at a distance away from said receiving element that is given by the radius of said RCC, with a concave side formed by said reflector facing said receiving element; and (c) electrically coupling said receiving element to the receiver.

* * * * *